US006379037B1

(12) United States Patent
Saleh et al.

(10) Patent No.: US 6,379,037 B1
(45) Date of Patent: Apr. 30, 2002

(54) SETTING MECHANISM FOR A TIMEPIECE

(75) Inventors: Muhammad A. Saleh, Woodbridge; John T. Houlihan, Southbury, both of CT (US)

(73) Assignee: Timex Group B.V. (NL)

( * ) Notice: Subject to any disclaimer, the term of this patent is extended or adjusted under 35 U.S.C. 154(b) by 0 days.

(21) Appl. No.: 09/525,798

(22) Filed: Mar. 15, 2000

(51) Int. Cl.[7] ..... G04B 37/00

(52) U.S. Cl. ..... 368/185; 368/74; 368/294; 368/295; 368/319

(58) Field of Search ..... 368/74, 185, 233, 368/287, 295, 308, 319, 69, 294

(56) References Cited

U.S. PATENT DOCUMENTS

| | | | | |
|---|---|---|---|---|
| 4,253,177 A | * | 2/1981 | Hafner | 368/187 |
| 5,305,291 A | * | 4/1994 | Kamens et al. | 368/74 |
| 5,742,565 A | | 4/1998 | Cuinet et al. | |
| 6,200,019 B1 | * | 3/2001 | Latini | 368/288 |

FOREIGN PATENT DOCUMENTS

| | | |
|---|---|---|
| CH | 559927 | 3/1975 |

* cited by examiner

*Primary Examiner*—Diego Gutierrez
*Assistant Examiner*—Jeanne-Marguerite Goodwin
(74) *Attorney, Agent, or Firm*—Carmody & Torrance LLP

(57) ABSTRACT

The present invention provides a rotational aid for setting a multimode electronic device of the type having a rotatable ring coupled to a switching mechanism. The rotational aid includes a handle and a device for coupling the handle to the ring. The handle is positionable in at least a retracted position and a deployed position. When in the deployed position, the handle projects outwardly from the ring such that the rotation of the ring is facilitated by the movement of the deployed handle. The present invention also provides a multimode electronic device having a case and an integrated circuit operable in a plurality of states. The electronic device includes a rotating switching mechanism at least partially disposed within the case. The switching mechanism includes a rotatable setting stem operatively coupled to the integrated circuit. The electronic device also includes a ring rotatably mounted on the case. The ring is coupleable to the switching mechanism. The electronic device further includes a rotational aid having a handle coupled to the ring. The handle is positionable in at least a retracted position and a deployed position. When in the deployed position, the handle projects outwardly from the ring to facilitate rotation of the ring.

7 Claims, 7 Drawing Sheets

SETTING MECHANISM FOR A TIMEPIECE

FIELD OF THE INVENTION

This invention relates generally to electronic devices such as timepieces, and in particular, to an improved setting mechanism for such devices.

BACKGROUND OF THE INVENTION

Setting mechanisms for electronic devices such as, for example, electronic timepieces are well known. Setting functions for electronic timepieces of an analog type may include manually operating a "crown" which protrudes from a side of the timepiece. The crown is connected to a setting stem, which, for example, engages a setting gear as is well know in the art. In response to the rotation of the crown, time indicating hands of the timepiece may be set.

The inventors of the present invention have realized that it may be difficult to rotate and/or access the crown or other setting mechanism of an electronic device during setting functions due to, for example, interference from an object blocking access to the setting mechanism (e.g., a user's wrist) or poor digit dexterity. Accordingly, the present invention provides an improved setting mechanism wherein a deployable handle assists access to and rotation of a ring or other setting mechanism of the device.

OBJECTS AND ADVANTAGES OF THE INVENTION

Therefore, it is an object and advantage of this invention to provide an improved setting mechanism for an electronic device such as, for example a timepiece, and, in particular, to facilitate the rotation of a ring on the device to provide the rotation of the setting mechanism.

Further objects and advantages of this invention will become more apparent from a consideration of the drawings and ensuing description.

SUMMARY OF THE INVENTION

The foregoing and other problems are overcome and the objects and advantages are realized by methods and apparatus in accordance with embodiments of this invention, wherein an improved setting mechanism for an electronic device is disclosed.

Generally speaking, the present invention provides a rotational aid for setting a multimode electronic device of the type having a rotatable ring coupled to a switching mechanism. The rotational aid includes a handle and a device for coupling the handle to the ring. The handle is positionable in at least a retracted position and a deployed position. When in the deployed position, the handle projects outwardly from the ring such that the rotation of the ring is facilitated by the movement of the deployed handle.

The present invention also provides a multimode electronic device having a case and an integrated circuit operable in a plurality of states. The electronic device also includes a rotating switching mechanism at least partially disposed within the case. The switching mechanism includes a rotatable setting stem operatively coupled to the integrated circuit. The electronic device further includes a ring rotatably mounted on the case. The ring is coupleable to the switching mechanism. The electronic device further includes a rotational aid having a handle coupled to the ring. The handle is positionable in at least a retracted position and a deployed position. When in the deployed position, the handle projects outwardly from the ring to facilitate rotation of the ring. In one embodiment, the ring includes a recess and the handle is positioned within the recess when the handle is in the retracted position. Preferably, a notch is provided in the handle to facilitate the movement of the handle from the retracted position to the deployed position. In another embodiment, the ring includes a recess and the handle is positioned within the recess when the handle is in the retracted position. A notch is provided in the ring to facilitate the movement of the handle from the retracted position to the deployed position.

The present invention also provides a device for facilitating rotation of a ring of a timekeeping device. The device includes a handle operable in a retracted position and a deployed position. The handle is coupled to the ring such that when in the deployed position, the handle extends further outwardly from the ring than when in the retracted position and facilitates rotation of the ring. In one embodiment, and when in the retracted position, the handle forms a portion of the ring. In another embodiment, the handle includes a head and a shaft pivotally coupling the head to the ring. In yet another embodiment, the handle includes an arcuate member pivotally coupled to the ring.

The present invention still further provides a setting mechanism for an electronic device of the type having a casing that includes a setting stem, a ring, and a rotational aid. The setting stem is rotatably mounted in the casing. The ring is rotatably mounted on the casing and is adapted to be manually rotatable. The ring is coupled to the setting stem such that, when the ring is rotated in one of a first and a second direction, the setting stem is similarly rotated in one of the first and the second directions. The rotational aid is coupled to the ring and operable within a retracted position and a deployed position. When in the deployed position the rotational aid projects outwardly from the ring to facilitate rotation of the ring. In one embodiment, and when in the retracted position, the rotational aid forms a portion of the ring.

BRIEF DESCRIPTION OF THE DRAWINGS

The above set forth and other features of the invention are made more apparent in the ensuing Detailed Description of the Preferred Embodiments when read in conjunction with the attached Drawings, wherein.

Identically labeled elements appearing in different ones of the above-described figures refer to the same elements but may not be referenced in the description for all figures.

DETAILED DESCRIPTION OF THE PREFERRED EMBODIMENTS

Figure 1:
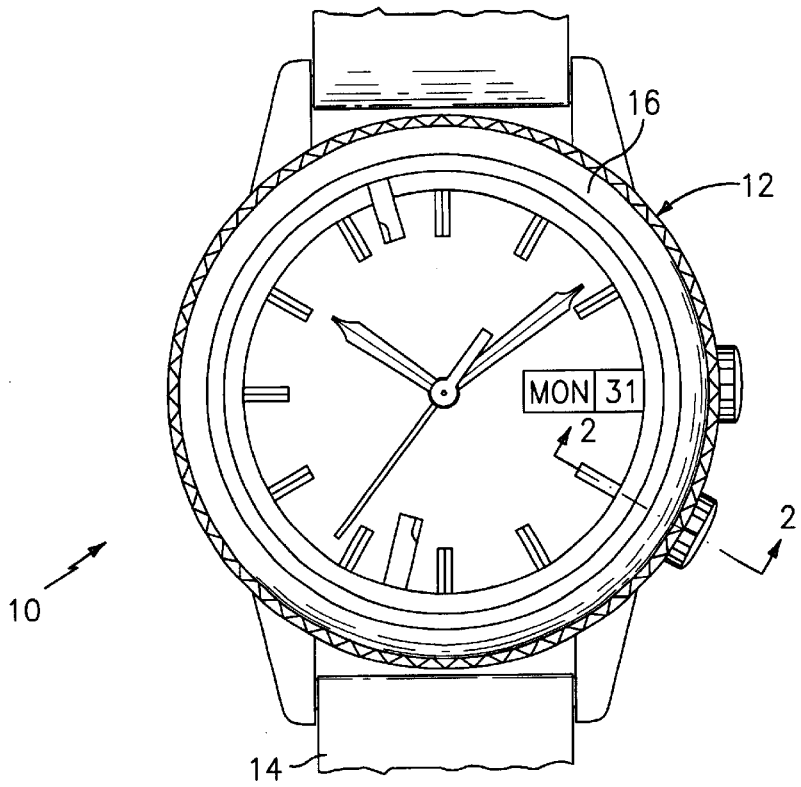
FIG. 1 (PRIOR ART)
FIG. 1 is a plan view of a conventional timepiece having a rotatable ring mounted thereto.
Figure 2:
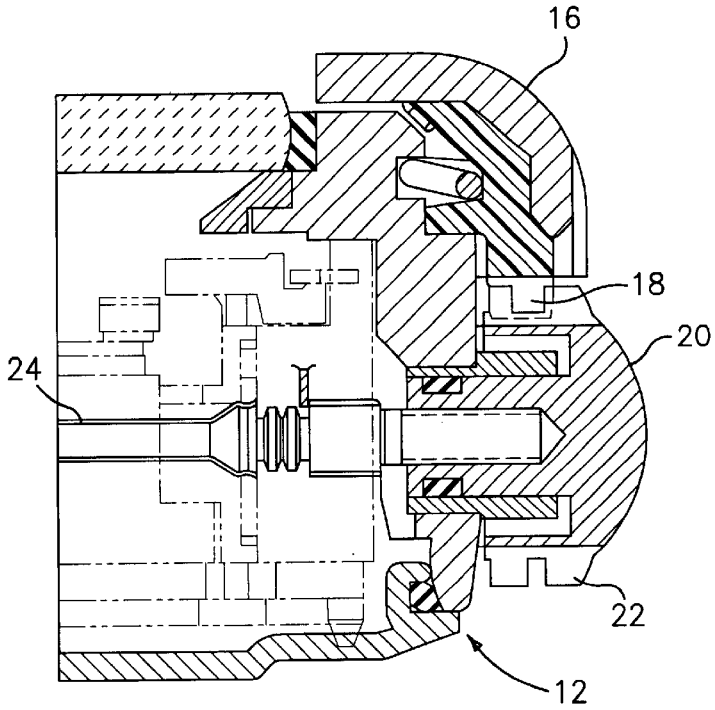
FIG. 2 (PRIOR ART)
FIG. 2 is a side, elevational view in partial cross-sectional of the timepiece of FIG. 1, taken along line II—II.

As noted in the Background Section, it is well known for setting mechanisms of some types of electronic devices to include manually operating crowns. An improvement to the "crown setting mechanism" of an electronic timepiece is described in U.S. Pat. No. 5,742,565, issued Apr. 21, 1998, entitled "Crown Setting Device For A Timepiece," by Cuinet et al., and is assigned to the assignee of the present invention. As shown in FIGS. 1 and 2, Cuinet et al. describe a rotatable ring 16 mounted on a casing 12 of a timepiece 10 and having gear teeth 18 which mesh with gear teeth 22 of a crown 20. When the ring 16 is rotated, the crown 20 is rotated. The rotation of the crown 20 results in the rotation of a setting stem 24 coupled thereto, which in turn permits setting of the timepiece 10. The improvement described by Cuinet et al. may be extended to electronic timepieces of the digital type by incorporating the rotatable ring 16 and a crown switching mechanism described in commonly assigned, copending U.S. patent application Ser. No. 09/327,769, filed Jun. 07, 1999, entitled "Crown Switching Mechanism", by Gerhard Stotz. That is, in response to the rotation of the ring 16, the crown switching mechanism described by Gerhard Stotz in the aforementioned application Ser. No. 09/327,769, generates signals utilized by a microprocessor of the digital electronic timepiece during predefined setting functions. The disclosure of this commonly assigned, copending U.S. patent application Ser. No. 09/327,769, is incorporated by reference herein in its entirety.

Figure 3A:
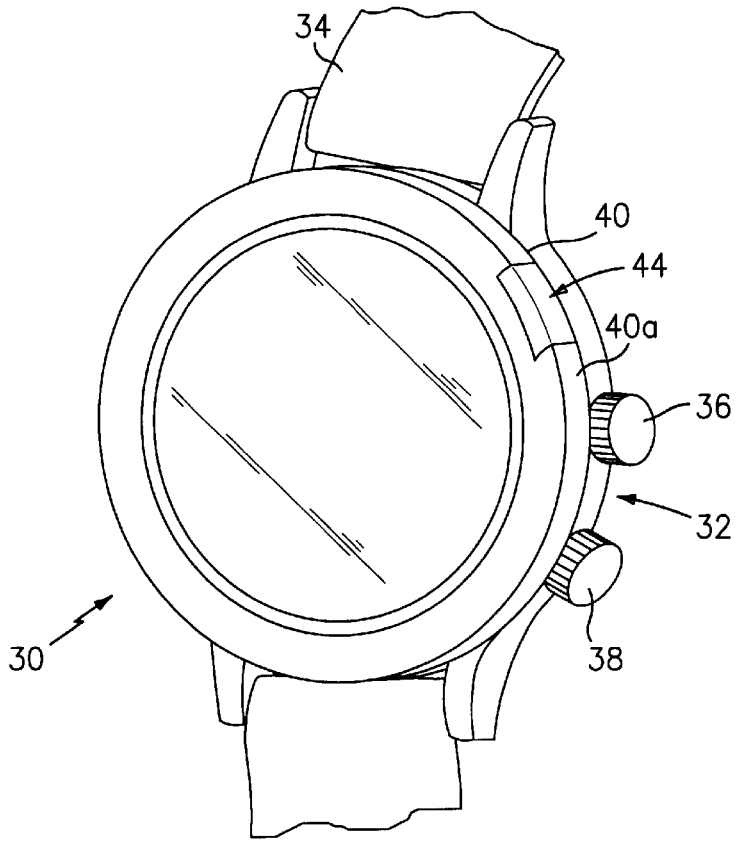
FIGS. 3A–3D are partial, perspective views of a timepiece having a rotational aid constructed in accordance with one embodiment of the present invention.

FIGS. 3A–3D are partial, perspective views of a timepiece 30, constructed in accordance with the present invention, having a casing, shown generally at 32, and a strap 34 for securing the casing to the wrist of a wearer. The timepiece 30 also includes a setting mechanism which, during at least one setting function, is manually manipulated to set the timepiece 30. The setting mechanism preferably includes at least one setting stem (not shown) rotatably mounted in the casing 32 and a crown actuator coupled thereto. For illustration purposes only, FIG. 3A illustrates two crown actuators 36 and 38. The setting mechanism also includes a ring 40 that is constructed in accordance with the present invention and rotatably mounted on the casing 32. It will be appreciated that the present invention need not employ an externally mounted crown actuator such as actuators 36 and 38. For example, it should be understood that the present invention may be employed within devices having a rotatable ring driving an internal gear such as is described in Swiss Patent No. 599 927, dated March 1975.

The ring 40 is similar to the rotatable ring described in the above-referenced U.S. Pat. No. 5,742,565, assigned to the assignee of the present invention. That is, the ring 40 preferably includes a first set of teeth that mesh with a second set of teeth located about an outer diameter of the crown actuators 36 and 38. As such, when the ring 40 is rotated, the crown actuators 36 and 38 are also rotated. The disclosure of this commonly assigned U.S. Pat. No. 5,742,565, is incorporated by reference herein in its entirety.

Figure 3B:
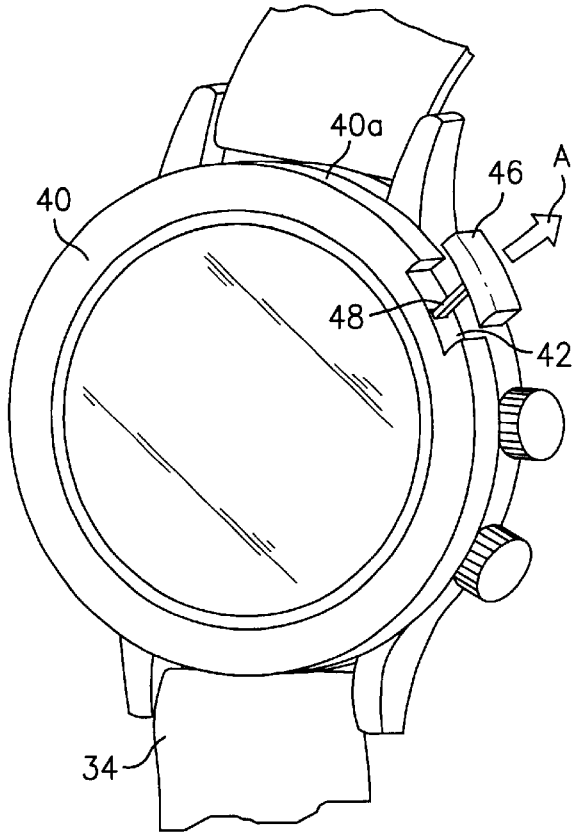
Figure 3C:
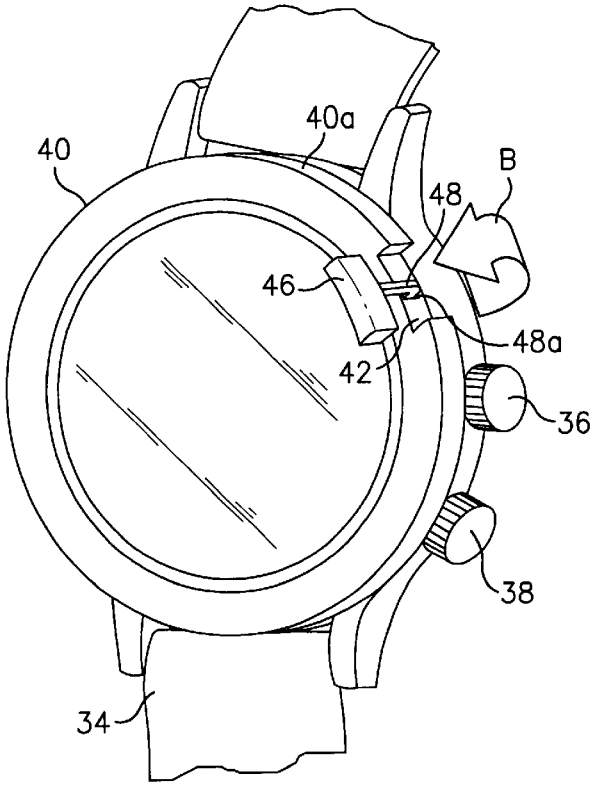
Figure 3D:
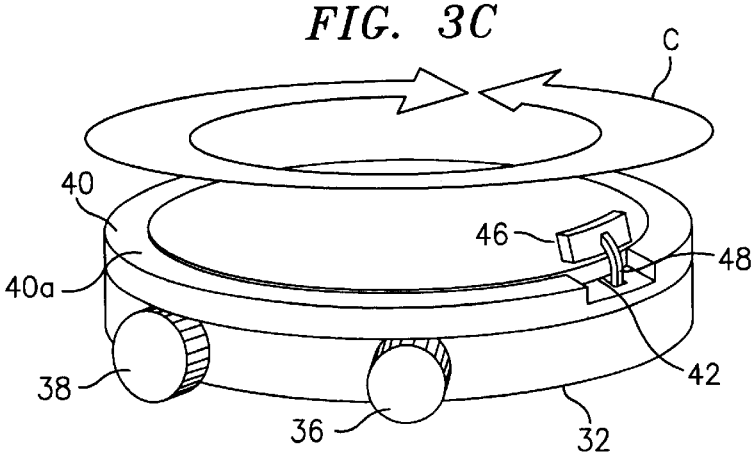

In accordance with one aspect of the present invention, the ring 40 includes a rotational aid, shown generally as a handle 44. The handle 44 is coupled to the ring 40 and is movable between a retracted position (shown, for example, in FIG. 3A) and a deployed position (shown, for example, in FIGS. 3C and 3D). The ring 40 also includes a recess, or groove 42 (FIG. 3B). In the retracted position, the groove 42 sufficiently accepts the handle 44 so that the handle 44 and an outer surface 40*a* of the ring 40 are preferably at least substantially coplanar and form an essentially continuous smooth outer surface of the ring 40. To achieve the deployed position, the handle 44 is pulled from its retracted position (FIG. 3A) by, for example, a user's fingers. To still further facilitate deployment thereof, a notch may be provided in the handle 44 to facilitate a user when inserting a fingernail or the like in the gap formed between the ring 40, the handle 44 and the notch.

In accordance with one embodiment of the present invention, shown in FIG. 3B, the handle 44 includes a head 46 and a shaft 48 coupled thereto. The shaft 48 couples the head 46 to the ring 40 by, for example, a hinge or spring mechanism details of which may be omitted as they would be well understood in the art. The coupling to the ring 40 permits axial and rotational movement of the head 46 in relation to the ring 40. In FIG. 3B the head 46 may be pulled outwardly (the pulling action is represented by a line A) from the ring 40 exposing the recess 42. In one embodiment, shown in FIG. 3C, the head may be pivotable about a connection 48*a* of the shaft 48 to the ring 40 (the pivoting action is represented by a line B) such that the head 46 is positionable within the diameter of the ring 40 and in a plane lying above the ring 40. That is, in the deployed position, the head 46 may project outwardly from the outer surface 40a of the ring 40. As illustrated in the side view of FIG. 3D, when in the deployed position the head 46 is easily manually manipulatable to rotate the ring 40 in a clockwise or counterclockwise direction (the rotation is represented by a line C). By rotating the ring 40, the setting stem is also rotated in a manner disclosed in the aforementioned U.S. Pat. No. 5,742,565. Therefore, the handle 44 (i.e., the head 46 and the shaft 48) provide a unique aid for rotating the ring 40 and, in the preferred embodiment, the crown actuators 36 and 38. Again, as the present invention is equally applicable to other devices as described below, the existence of crown actuators 36 and 38 are not material to the present invention.

As should be appreciated, it is within the scope of the present invention to provide multiple configurations of the head 46 and the shaft 48. For example, in the first embodiment shown in FIGS. 3A–3D, the head 46 is configured in the retracted position to substantially "blend in" as a portion of the ring 40.

Figure 4C:
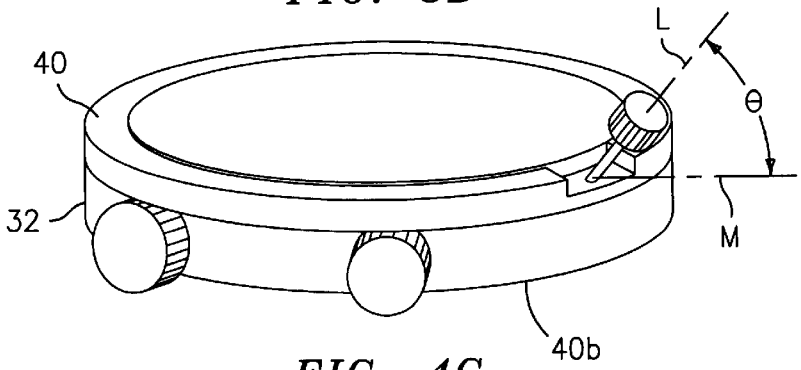
FIG. 4C is partial, perspective view of a timepiece having a rotational aid constructed in accordance with yet another embodiment of the present invention.
Figure 4A:
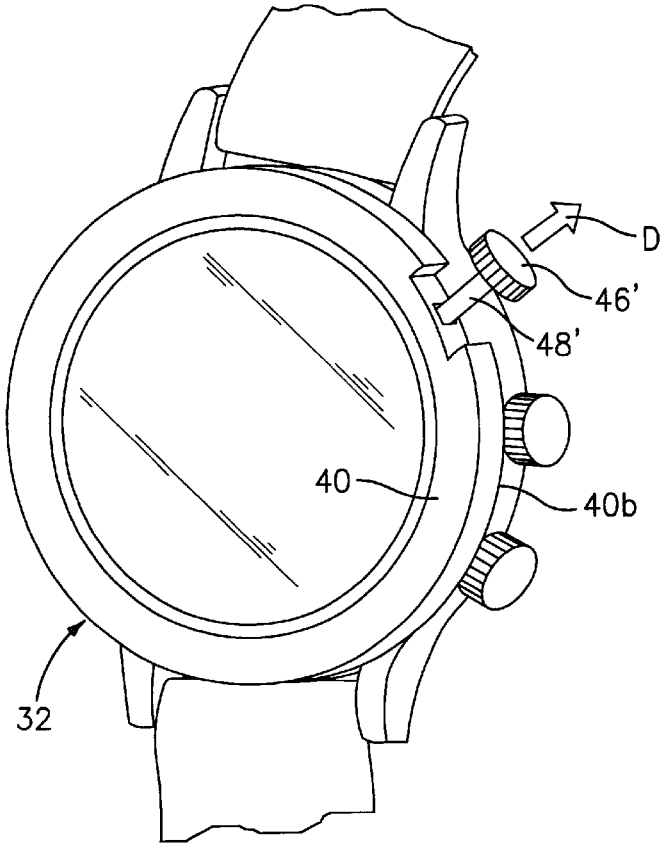
FIGS. 4A and 4B are partial, perspective views of a timepiece having a rotational aid constructed in accordance with a second embodiment of the present invention.
Figure 4B:
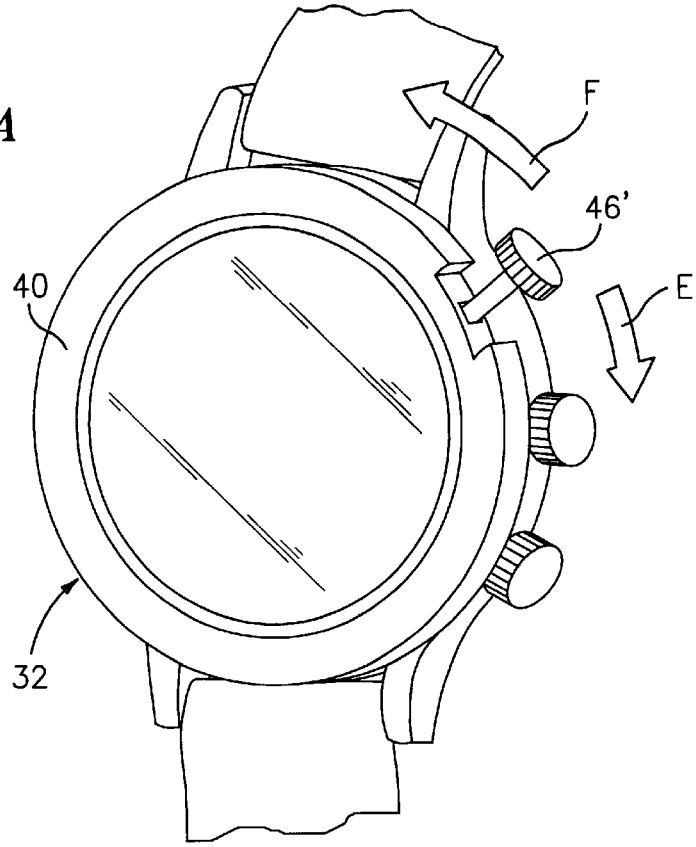

In a second embodiment shown in FIGS. 4A–4C, the head 46 is configured to substantially appear as a crown actuator. It should be appreciated that it is within the scope of the present invention for the deployed position of the rotational aid to extend radially from the ring 40. For example, FIGS. 4A and 4B illustrate this alternate embodiment wherein the deployed position of the rotational aid is achieved by pulling a head 46' (where the pulling action is represented by a line D) such that the head 46' projects radially from the ring 40 in the same horizontal plane. That is, the horizontal plane is generally parallel with the ring 40. In the alternate deployed position the head 46' is manually manipulated to rotate the ring 40 in the clockwise direction (represented by a line E) and the counterclockwise direction (represented by a line F).

It is further contemplated that, in the deployed position, the handle 44 may be oriented at an angle, such as along an axis L, relative to the horizontal plane of the device, which is in parallel with the lateral surface 40*b* of the ring 40 (FIG. 4A and 4C). That is, as is shown in FIG. 4C, the handle 44 protrudes from the ring 40 at an angle θ formed by the axis L and the horizontal plane (represented in FIG. 4C by a line M). The angle θ is preferably greater than about 0° and less than about 90°.

Figure 5A:
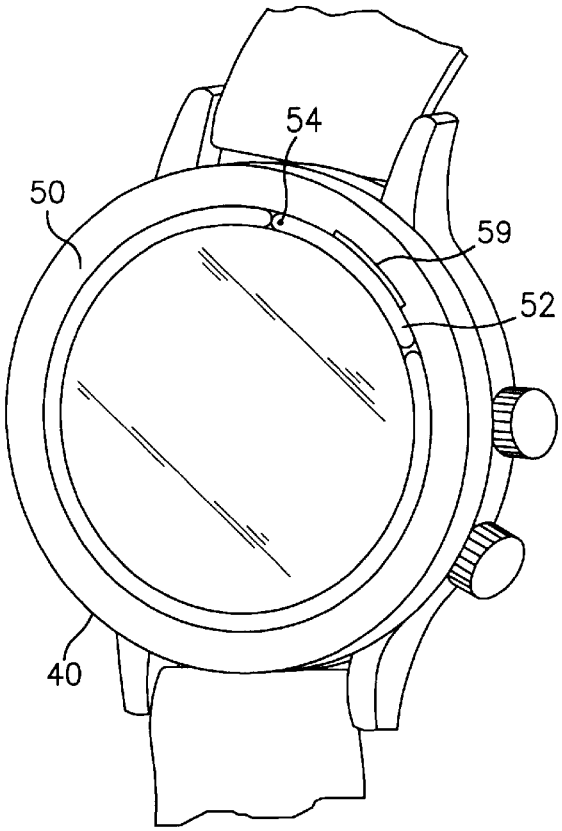
FIGS. 5A–5C are partial, perspective views of a timepiece having a rotational aid constructed in accordance with a fourth embodiment of the present invention.
Figure 5B:
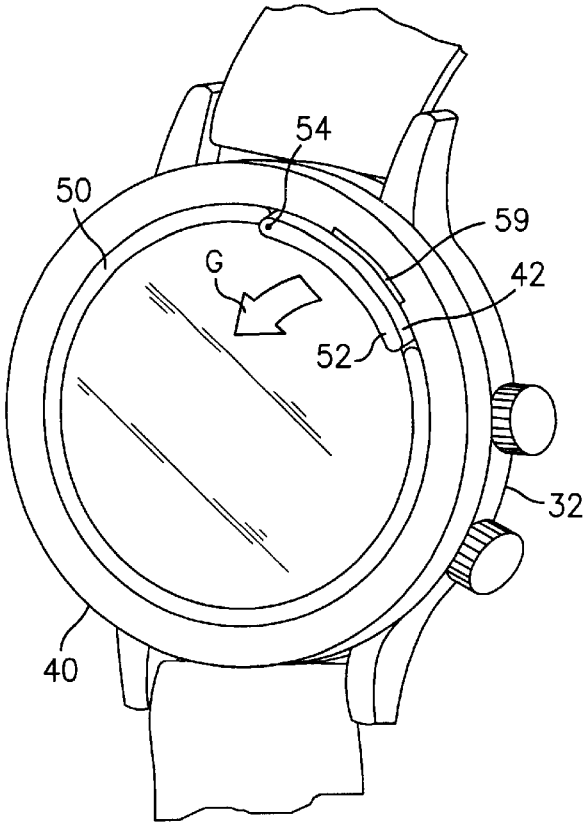
Figure 5C:
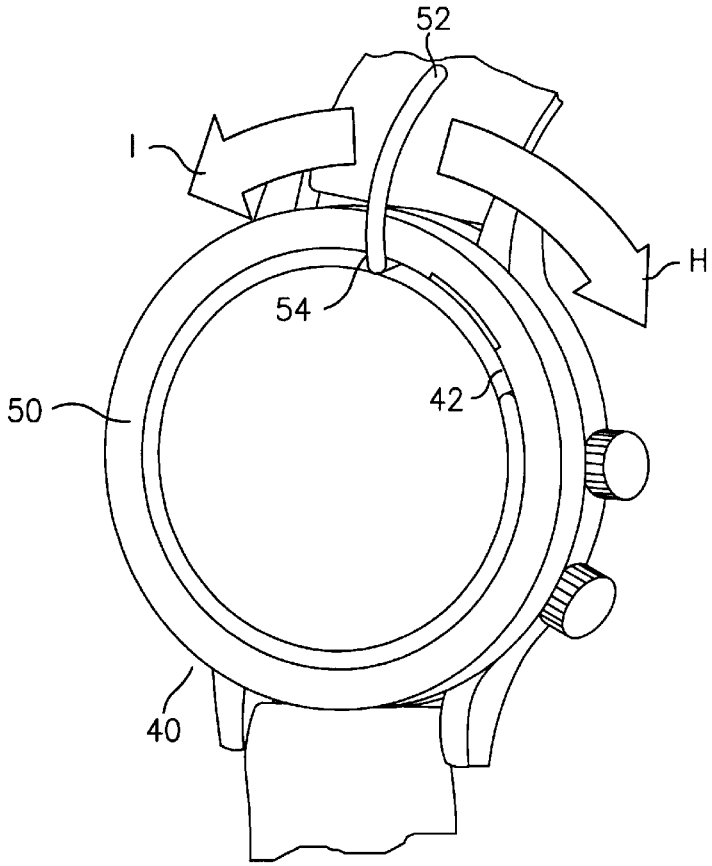

In yet another embodiment of the present invention, the rotational aid includes a shaft and a head forming a portion of a ring located on the outer surface 40*a* of the ring 40. For example, in FIGS. 5A–5C a ring 50 is located on the ring 40. As shown, the handle 44 includes an arm 52 of the ring 50. As with the embodiments discussed above, the arm 52 is operable in a retracted position (FIG. 5A) and a deployed position (FIG. 5C). To achieve the deployed position, the arm 52 is first lifted or pulled outwardly (the pulling action is represented by a line G) from the retracted position within the groove 42. As shown in FIG. 5A, a notch 59 in the ring 40 may be provided so as to facilitate the grabbing and deployment of the arm 52 in a similar manner to the way in which head 46 may be deployed. In this pulled position the arm 52 preferably lies in a horizontal plane above the ring 40. From the pulled position the arm 52 may rotate away from the casing 32 into the deployed position by pivoting about a shaft 54. That is, the arm 52 is mounted on the shaft 54 to permit vertical movement of the arm 52 from the retracted position to the horizontal plane above the ring 40 and, further, to permit rotatable movement of the arm 52 in a circular path about the shaft 54. Preferably, the shaft 54 and the arm 52 cooperate such that the arm 52 may releasably lock within the deployed position (FIG. 5C) to substantially prevent excessive undesirable independent rotation of the arm 52 about the shaft 54.

Once in the deployed position, the arm 52 is manually manipulatable to assist in rotating the ring 40 in a clockwise direction (represented by a line H), and a counterclockwise direction (represented by a line I). It is also within the scope of the present invention to provide a hinge mechanism such that, once deployed, the arm 52 may be positioned so as to extend upwardly and generally perpendicular to the display surface, dial or face of the device. This may further facilitate rotation of the ring 40. Once the setting functions of interest are complete, the arm 52 is unlocked and returned to the retracted position.

Figure 6A:
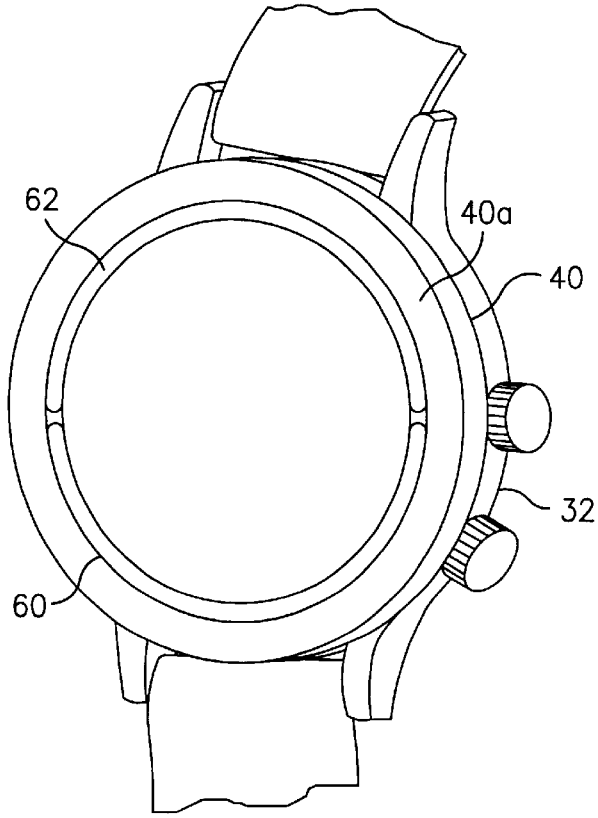
FIGS. 6A–6C are partial, perspective views of a timepiece having a rotational aid constructed in accordance with still another embodiment of the present invention.
Figure 6B:
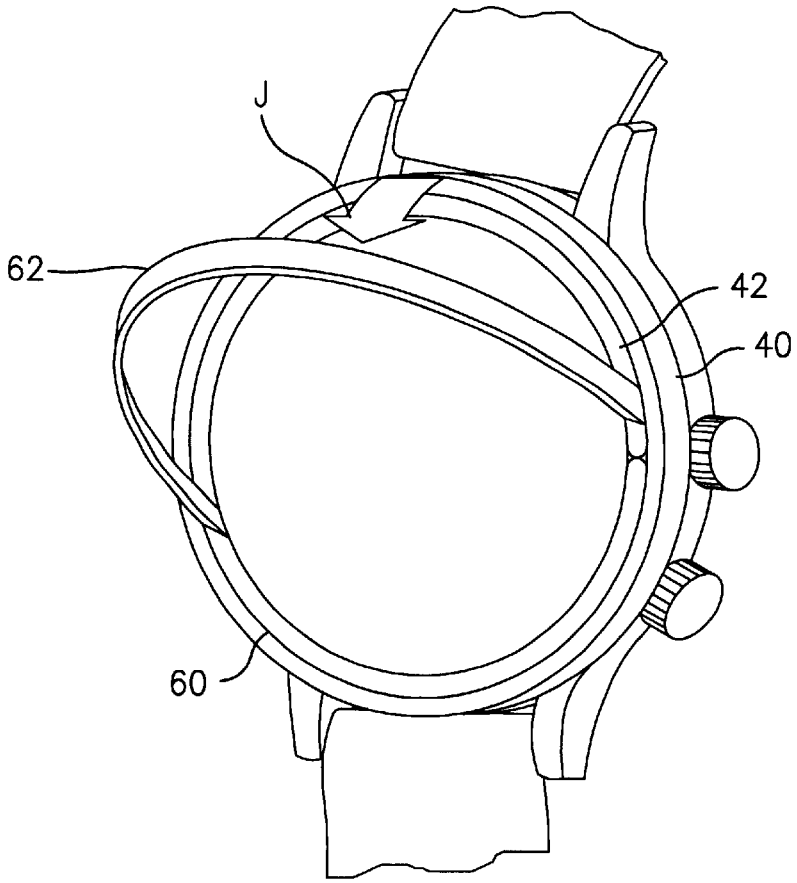
Figure 6C:
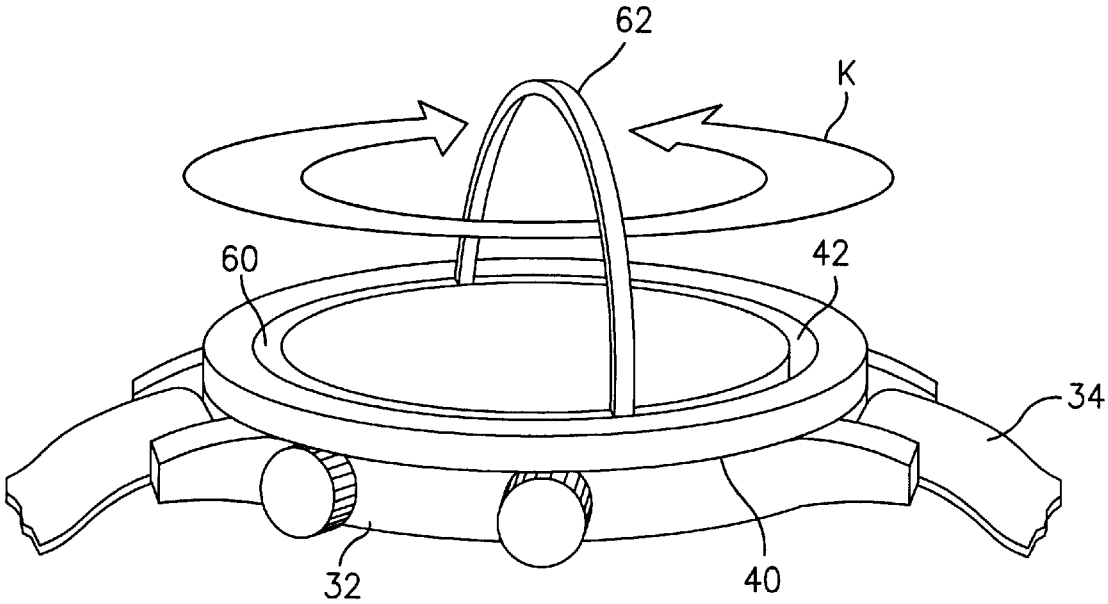

FIGS. 6A–6C illustrate yet a further embodiment of the rotational aid wherein an arm 62 of a ring 60 is provided on the outer surface 40a of the ring 40. The arm 62 is operable in a retracted position (FIG. 6A) and a deployed position (FIG. 6C). In the retracted position (FIG. 6A), the groove 42 accepts the arm 62 so that the arm 62 and the outer surface 40*a* of the ring 40 form a substantially smooth outer surface of the ring 40. In the deployed position (FIG. 6C), the arm 62 projects outwardly from the ring 40 in a plane perpendicular to the display surface of the device.

In transitioning from the retracted position to the deployed position the arm 62 is pulled outwardly (the pulling action is represented by a line J of FIG. 6B) from the ring 40 and may be facilitated by the aforementioned notch 59. As such, the arm 62 pivots vertically about connections to the ring 40 until the arm 62 is positioned in a plane generally perpendicular to the ring 40. As illustrated in FIG. 6C, when in the deployed position the arm 62 is manually manipulatable to rotate the ring 40 in a clockwise direction and a counterclockwise direction (the rotation is represented by a line K). By rotating the ring 40, the setting stem is also rotated, again in a manner as disclosed in the aforementioned U.S. Pat. No. 5,742,565.

Preferably, the arm 62 can be releasably locked within the deployed position (FIG. 6C) to substantially prevent the arm 62 from undesirably and prematurely rotating back toward the retracted position during rotation thereof. Such a locking mechanism is well known within the ordinary skill of one in the pertinent art.

It follows, therefore, that the present invention achieves an improved setting mechanism for an electronic device of the type having a setting mechanism that includes, for example, a rotatable ring by providing a rotational aid to facilitate the rotation of the ring.

Although described in the context of preferred embodiments, it should be realized that a number of modifications to these teachings may occur to one skilled in the art. As should be appreciated, the scope of the present invention is not limited to setting mechanisms for wristwatches and/or timepieces. Rather, it is also contemplated that the handle 44 may be affixed to a setting ring rotatably mounted to any electronic device having setting functions driven by, for example, the setting ring.

That is, one skilled in the art should now appreciate that the present invention is equally applicable, and as claimed herein, to devices other than watches and/or timepieces, such as, but not limited to, clocks, thermostats, security devices or other suitable wall mounted or handheld devices for use in, for example, a home, an office, a vehicle or any indoor or outdoor area. Therefore, reference to a watch or timepiece should equally be understood to refer to at least any of the aforementioned other devices. That is, the present invention is applicable in any electronic device in which a switching mechanism, such as those disclosed herein, permits selective mode and/or information setting or activation activities as set forth above.

While the invention has been particularly shown and described with respect to preferred embodiments thereof, it will be understood by those skilled in the art that changes in form and details may be made therein without departing from the scope and spirit of the invention.

What is claimed is:

1. A multimode electronic device, the device comprising:

a casing;

a switching mechanism at least partially disposed within the casing, the switching mechanism comprising a rotatable setting stem;

a ring rotatably mounted on the casing, the ring being coupled to the switching mechanism; and a rotational aid, the rotational aid comprising a handle coupled to the ring, the handle being positionable in at least a retracted position and a deployed position;

wherein when in the deployed position, the handle projects outwardly from the ring;

wherein the rotation of the ring has been added before "ring" to better describe the invention in such a way that an angular sweep through which the rotational aid will rotate is the same as an angular sweep through which the ring will rotate when both the rotational aid and the ring are together rotated in a clockwise or counterclockwise direction.

2. The electronic device as claimed in claim 1, wherein the ring includes a recess, wherein the handle is positioned within the recess when the handle is in the retracted position.

3. The electronic device as claimed in claim 2, and wherein a notch is provided in the handle to facilitate the movement of the handle from the retracted position to the deployed position.

4. The electronic device as claimed in claim 1, wherein the ring includes a recess, wherein the handle is positioned within the recess when the handle is in the retracted position, and wherein a notch is provided in the ring to facilitate the movement of the handle from the retracted position to the deployed position.

5. The device as set forth in claim 1, wherein the handle is comprised of a head and a shaft pivotally coupling the head to the ring.

6. The device as set forth in claim 1, wherein the handle is comprised of an arcuate member pivotally coupled to the ring.

7. The timepiece as claimed in claim 1, wherein the device is a watch.

* * * * *

UNITED STATES PATENT AND TRADEMARK OFFICE

CERTIFICATE OF CORRECTION

PATENT NO. : 6,379,037 B1 
DATED : April 30, 2002
INVENTOR(S) : Muhammad A. Saleh and John T. Houlihan It is certified that error appears in the above-identified patent and that said Letters Patent is hereby corrected as shown below:

Column 6,
Lines 27-45, delete claim 1 and replace it with the following:

-- 1. A multimode electronic device, the device comprising:

a casing;

a switching mechanism at least partially disposed within the casing, the switching mechanism comprising a rotatable setting stem;

a ring rotatably mounted on the casing, the ring being coupled to the switching mechanism; and a rotational aid, the rotational aid comprising a handle coupled to the ring, the handle being positionable in at least a retracted position and a deployed position;

wherein when in the deployed position, the handle projects outwardly from the ring;

wherein the rotation of the rotational aid causes the rotation of the ring in such a way that an angular sweep through which the rotational aid will rotate is the same as an angular sweep through which the ring will rotate when both the rotational aid and the ring are together rotated in a clockwise or counterclockwise direction. --

Signed and Sealed this

First Day of October, 2002

*Attest:*

*Attesting Officer*

JAMES E. ROGAN
*Director of the United States Patent and Trademark Office*